US011242852B2

(12) United States Patent
Bennett, Sr. et al.

(10) Patent No.: US 11,242,852 B2
(45) Date of Patent: Feb. 8, 2022

(54) VARIABLE DISPLACEMENT OIL PUMP SLIDE WITH BOW SPRING

(71) Applicant: GM Global Technology Operations LLC, Detroit, MI (US)

(72) Inventors: Andy Bennett, Sr., Rochester Hills, MI (US); Sean McGowan, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 166 days.

(21) Appl. No.: 16/371,874

(22) Filed: Apr. 1, 2019

(65) Prior Publication Data

US 2020/0309120 A1 Oct. 1, 2020

(51) Int. Cl.
*F04C 14/22* (2006.01)
*F04C 2/344* (2006.01)

(52) U.S. Cl.
CPC ..... *F04C 14/226* (2013.01); *F04C 2/3442* (2013.01); *F04C 2210/206* (2013.01); *F04C 2240/20* (2013.01)

(58) Field of Classification Search
CPC .. F04C 14/226; F04C 2/3442; F04C 2240/20; F04C 2210/206
See application file for complete search history.

(56) References Cited

U.S. PATENT DOCUMENTS

| | | | | | |
|---|---|---|---|---|---|
| 4,581,960 | A * | 4/1986 | Putsch | B25B 7/10 | 81/411 |
| 5,800,131 | A * | 9/1998 | Lehmann | F04C 14/226 | 417/220 |
| 8,210,836 | B2 * | 7/2012 | Schneider | F04C 2/3445 | 418/26 |

FOREIGN PATENT DOCUMENTS

| | | | | |
|---|---|---|---|---|
| DE | 2002016 | A | 1/1970 | |
| DE | 102004020603 | A1 * | 12/2005 | F04C 2/3442 |
| DE | 102004020603 | A1 | 12/2005 | |
| DE | 102005033293 | A1 | 1/2007 | |
| DE | 102006021971 | A1 | 4/2007 | |
| DE | 102008000322 | A1 * | 8/2009 | F04C 2/3442 |
| DE | 102013218018 | A1 | 3/2015 | |
| JP | 57062986 | A * | 4/1982 | F04C 14/226 |
| WO | 2007039012 | A1 | 4/2007 | |

* cited by examiner

*Primary Examiner* — Mary Davis
*Assistant Examiner* — Paul W Thiede
(74) *Attorney, Agent, or Firm* — Vivacqua Crane PLLC

(57) ABSTRACT

An automobile vehicle variable displacement pump includes a pump body having a pump shaft extending through the pump body. A rotor is connected to the pump shaft and co-rotates with the pump shaft. The rotor has multiple radially outwardly directed slots. A vane support ring supports multiple vanes, the vanes individually slidably received in one of the slots of the rotor. A slide is rotatably connected to the pump body having the rotor and the vane support ring positioned within an inner wall of the slide. A bow spring plate defining a biasing member directly contacts the slide to bias the slide to rotate about an arc of curvature.

16 Claims, 5 Drawing Sheets

VARIABLE DISPLACEMENT OIL PUMP SLIDE WITH BOW SPRING

INTRODUCTION

The present disclosure relates to oil and hydraulic fluid pumps and in particular to variable displacement pumps used in automobile and truck systems.

Automobile vehicles commonly use a variable displacement pump to deliver pressurized oil to various engine components. Known variable displacement pumps used for this purpose are directly rotated by rotation of an engine component such as a shaft, and therefore vary in rotational speed as the engine speed changes. Variable displacement pumps offer a variable delivery rate of oil.

Known variable displacement pumps used for this function employ a compression spring providing a biasing force to vary an output flow rate of the pump. Compression springs are simple and require little or no adjustment, but often require addition of reinforced spring seating surfaces outside of a space envelope required for a slide section of the pump. The spring seating surfaces and a distance providing for spring expansion and contraction increase a weight and a cost of the pump, and further add to a space envelope required for the pump. In addition, the compression spring bends off-axis during operation and commonly requires a center alignment member be added to maintain consistent spring force over the entire operating range of the compression spring. Further, compression spring deflection is not linear over a range between 30% to 70% deflection, therefore creating inconsistent pump output flow over this range of spring operation.

Thus, while current vehicle oil system variable displacement pumps achieve their intended purpose, there is a need for a new and improved variable displacement pump and method for operation of a variable displacement pump for vehicle oil system operation.

SUMMARY

According to several aspects, a variable displacement pump includes a pump body having a pump shaft extending through the pump body. The pump shaft rotates with respect to a longitudinal axis of the pump shaft. A slide is rotatably connected to the pump body. A bow spring plate defining a biasing member directly contacts the slide to bias the slide to rotate about an arc of curvature within the pump body.

In another aspect of the present disclosure, a dowel pin is positioned within a dowel pin cavity of the slide, the dowel pin rotatably connecting the slide to an inner wall of the pump body.

In another aspect of the present disclosure, the bow spring plate is anchored at an end of the bow spring plate between the dowel pin and the pump body.

In another aspect of the present disclosure, the slide includes a seal positioned within a seal cavity. A load force generated by the bow spring plate is equal to an oppositely directed pressure force acting against a surface of the slide between the seal cavity and the dowel pin cavity.

In another aspect of the present disclosure, a rotor is connected to the pump shaft and co-rotates with the pump shaft, the rotor having multiple radially outwardly directed slots.

In another aspect of the present disclosure, a vane support ring supports multiple vanes, the vanes individually slidably received in one of the slots of the rotor, the vanes rotating with the vane support ring by rotation of the rotor.

In another aspect of the present disclosure, the slide includes a circular-shaped inner wall, the rotor and the vane support ring being positioned within the inner wall of the slide.

In another aspect of the present disclosure, the vanes have an outward end maintained in direct contact with the inner wall of the slide as the vane support ring co-rotates with the rotor.

In another aspect of the present disclosure, an axis of the vane support ring is positioned off-axis with respect to the longitudinal axis of the pump shaft such that rotation of the vane support ring defines an obround path with respect to the longitudinal axis of the pump shaft at rotated positions of the slide.

In another aspect of the present disclosure, the bow spring plate directly contacts the slide at a free end of the bow spring plate defining a convex surface.

According to several aspects, a variable displacement pump includes a pump body having a pump shaft extending through the pump body. A rotor is connected to the pump shaft and co-rotates with the pump shaft. The rotor has multiple radially outwardly directed slots. A vane support ring supports multiple vanes, the vanes individually slidably received in one of the slots of the rotor. A slide is rotatably connected to the pump body having the rotor and the vane support ring positioned within an inner wall of the slide. A bow spring plate defining a biasing member directly contacts the slide to bias the slide to rotate about an arc of curvature.

In another aspect of the present disclosure, a dowel pin is positioned within a dowel pin cavity of the slide, the dowel pin rotatably connecting the slide to an inner wall of the pump body. The dowel pin anchors the bow spring plate to the pump body at an end of the bow spring plate between the dowel pin and the pump body.

In another aspect of the present disclosure, the slide includes a seal cavity having a seal positioned within the seal cavity contacting an inner wall of the pump body, the seal acting to limit fluid from entering an outer chamber positioned between the slide and the pump body.

In another aspect of the present disclosure, a load force generated by the bow spring plate is equal to an oppositely directed pressure force acting against a surface of the slide within the outer chamber.

In another aspect of the present disclosure, a first end of the bow spring plate has a convex shaped portion in direct sliding contact with a curved outer wall portion of the slide acting to minimize frictional contact between the bow spring plate and the slide.

In another aspect of the present disclosure, the bow spring plate includes a second end seated in a slot created in a wall of the pump body.

In another aspect of the present disclosure, the pump shaft and the rotor rotate with respect to a longitudinal axis of the pump shaft, with the vane support ring defining an obround path of motion as the pump shaft rotates about the longitudinal axis.

According to several aspects, a variable displacement pump includes a pump body having a pump shaft extending through the pump body. The pump shaft rotates with respect to a longitudinal axis of the pump shaft. The rotor is connected to the pump shaft and co-rotates with the pump shaft with respect to the longitudinal axis of the pump shaft. The rotor has multiple radially outwardly directed slots. A vane support ring supports multiple vanes individually slidably received in one of the slots of the rotor and rotated by contact between the vanes and the rotor during rotation of the rotor. The vane support ring travels about an obround path of motion as the pump shaft rotates about the longitudinal axis. A slide is rotatably connected to the pump body having the rotor and the vane support ring positioned within an inner wall of the slide. A bow spring plate defining a biasing member directly contacts the slide to bias the slide to rotate about an arc of curvature. A biasing force generated by the bow spring plate acts toward the pump shaft and opposes an overall pressure force of a fluid within an outer chamber between the slide and the pump body.

In another aspect of the present disclosure, a dowel pin is positioned within a dowel pin cavity of the slide. The dowel pin rotatably connects the slide to an inner wall of the pump body. The bow spring plate includes a first end defining a convex surface directly contacting the slide and a second end anchored to the pump body between the dowel pin and the pump body.

In another aspect of the present disclosure, the bow spring plate includes a first end defining a convex surface directly contacting the slide and a second end seated in a slot created in a wall of the pump body.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
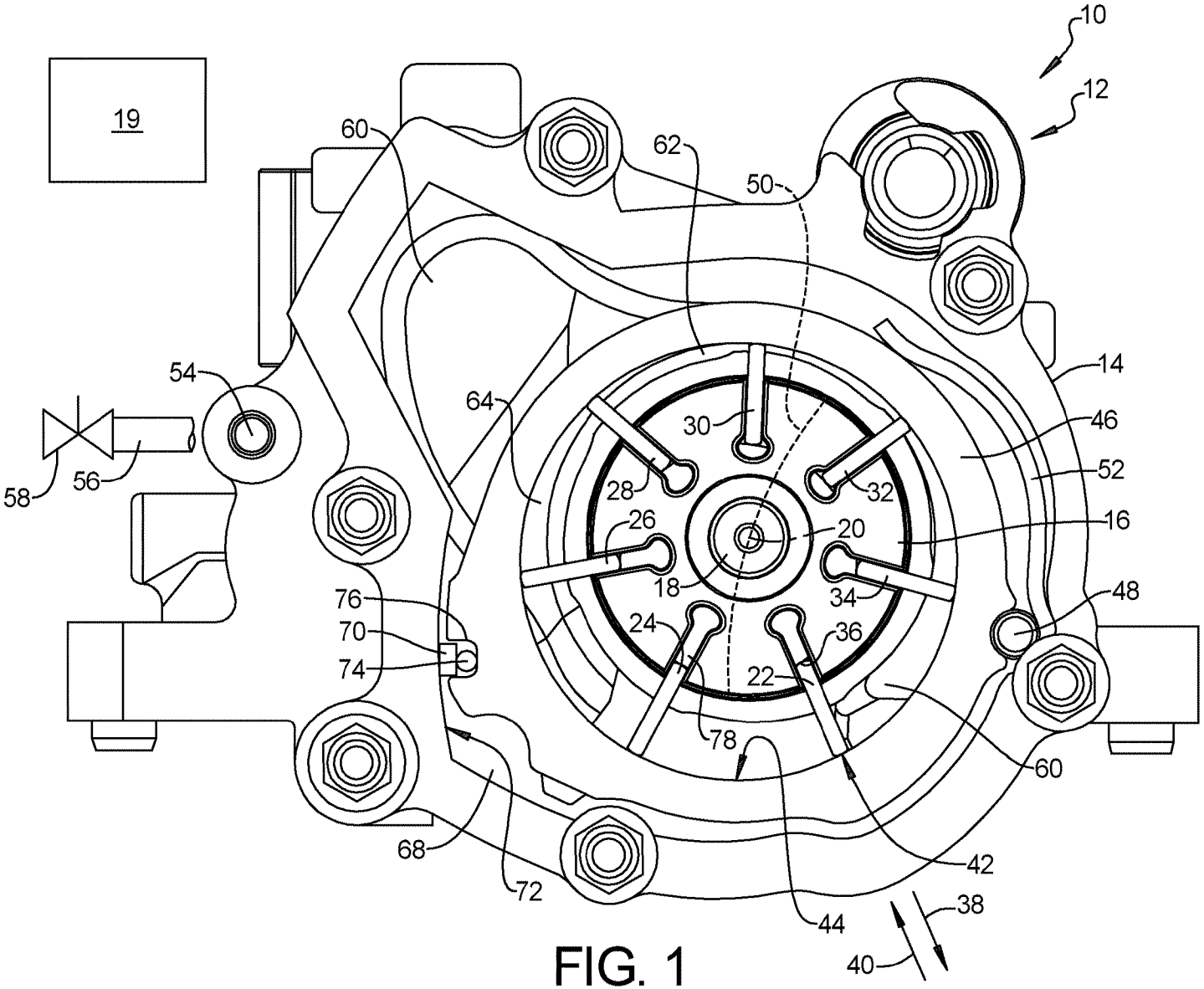
FIG. 1 is a top plan view of a variable displacement pump with a pump cover removed according to an exemplary aspect.

Referring to FIG. 1, a variable displacement pump system 10 of the present disclosure provides a variable displacement pump 12 having a pump body 14 made for example from laser cut, hardened and steam treated steel, or forged steel, or a powdered metal. The variable displacement pump 12 is shown with an end cover removed for visibility of the interior components. A rotor 16 is connected to and co-rotates by axial rotation of a pump shaft 18. The pump shaft 18 can be rotated by a rotational component (not shown) of an automobile vehicle engine 19, shown schematically, and therefore changes rotational speed directly with a change in rotational speed in revolutions per minute of the engine 19. The pump shaft 18 and therefore the rotor 16 rotate with respect to a longitudinal axis 20 directed toward the viewer as shown in FIG. 1.

The rotor 16 supports multiple vanes which are radially outwardly directed with respect to the longitudinal axis 20. The vanes can vary in quantity, and in accordance with several aspects include a first vane 22, a second vane 24, a third vane 26, a fourth vane 28, a fifth vane 30, a sixth vane 32 and a seventh vane 34. The vanes are slidably individually disposed in one of multiple vane slots of the rotor 16, such as for example the first vane 22 is slidably disposed in a first vane slot 36. During rotation of the pump shaft 18 the vanes such as the first vane 22 will alternately outwardly displace in a radial outward direction 38 with respect to the longitudinal axis 20 and oppositely displace in a radial inward direction 40 with respect to the longitudinal axis 20. Rotation of the rotor 16 which rotates the vanes generates a pumping action for a fluid such as motor oil received in the variable displacement pump 12. The vanes have an outward end 42 which can directly contact or are maintained within a clearance dimension of a circular-shaped inner wall 44 of a slide 46 during rotation of the rotor 16.

The slide 46 is rotatably mounted in the pump body 14 using a dowel pin 48 with the dowel pin 48 defining a pivot point for back-and-forth rotation of the slide 46 with respect to an arc of rotation 50. A biasing member which according to several aspects defines a bow spring plate 52 made for example of a spring steel is anchored at one end to the dowel pin 48 and directly contacts the slide 46 at a free end of the bow spring plate 52 to bias the slide 46 about the arc of rotation 50 in a counterclockwise direction of rotation as viewed in FIG. 1. Hydraulic forces within the pump body 14 oppose the biasing force generated by the bow spring plate 52 during operation of the variable displacement pump 12.

Low pressure oil discharged from the engine 19 is directed to the variable displacement pump 12 via a flow line 56 and is directed into a low-pressure intake cavity 60. From the low-pressure intake cavity 60 oil is directed both above and below opposed ends of the slide 46 (toward and away from the viewer as shown in FIG. 1) where the oil flows into a flow passage 62 of the slide 46. The flow passage 62 is located between the circular-shaped inner wall 44 of the slide 46 and an outer perimeter wall 64 of the rotor 16. The flow passage 62 continuously increases in passage size from an entrance end toward a mid-point 66 of the flow passage 62, which is located for example proximate to the temporary position shown for the second vane 24. From the mid-point 66 the flow passage 62 then continuously decreases in passage area toward a tapering geometry outlet 68 where the oil now pressurized by rotation of the vanes is discharged from the variable displacement pump 12. An oil pressure control device 70 such as an oil control regulating valve in communication with an oil gallery communicates via a gallery port 72 with an outer chamber 74. The outer chamber 74 is provided between the slide 46 and the pump body 14 to allow space for a free arc of travel of the slide 46 as the slide 46 rotates with respect to the dowel pin 48.

Oil pressure in the oil gallery and therefore at the gallery port 72 is generally different than the oil pressure at the low-pressure intake cavity 60. The seal member 80 is positioned in a seal cavity 82, the seal member 80 being made of a resilient material, and the biasing member 84 of the bow spring plate 52 continuously biases the seal member 80 into contact with the vanes. The seal member 80 and the biasing member 84 therefore co-rotate with the slide 46 as the slide 46 rotates with respect to the axis of rotation defined by the dowel pin 48.

Referring to FIG. 2 and again to FIG. 1, the vanes such as the exemplary second vane 24 directly contact the vane support rings 86 and if the vane support rings 86 are displaced to an off-axis position with respect to the longitudinal axis 20 of the pump shaft 18 the vanes are alternately induced to inwardly and outwardly displace within the vane slots such as the first vane slot 36. The two vane support rings 86 are slidably disposed on oppositely directed faces of the rotor 16. The vanes increase oil pressure and generate oil flow during rotation of the rotor 16 by displacing the oil received at the low-pressure intake cavity 60 through the flow passage 62 and out via the outlet 68 when the vane support rings 86 are displaced off-axis with respect to the longitudinal axis 20 of the pump shaft 18.

Figure 2:
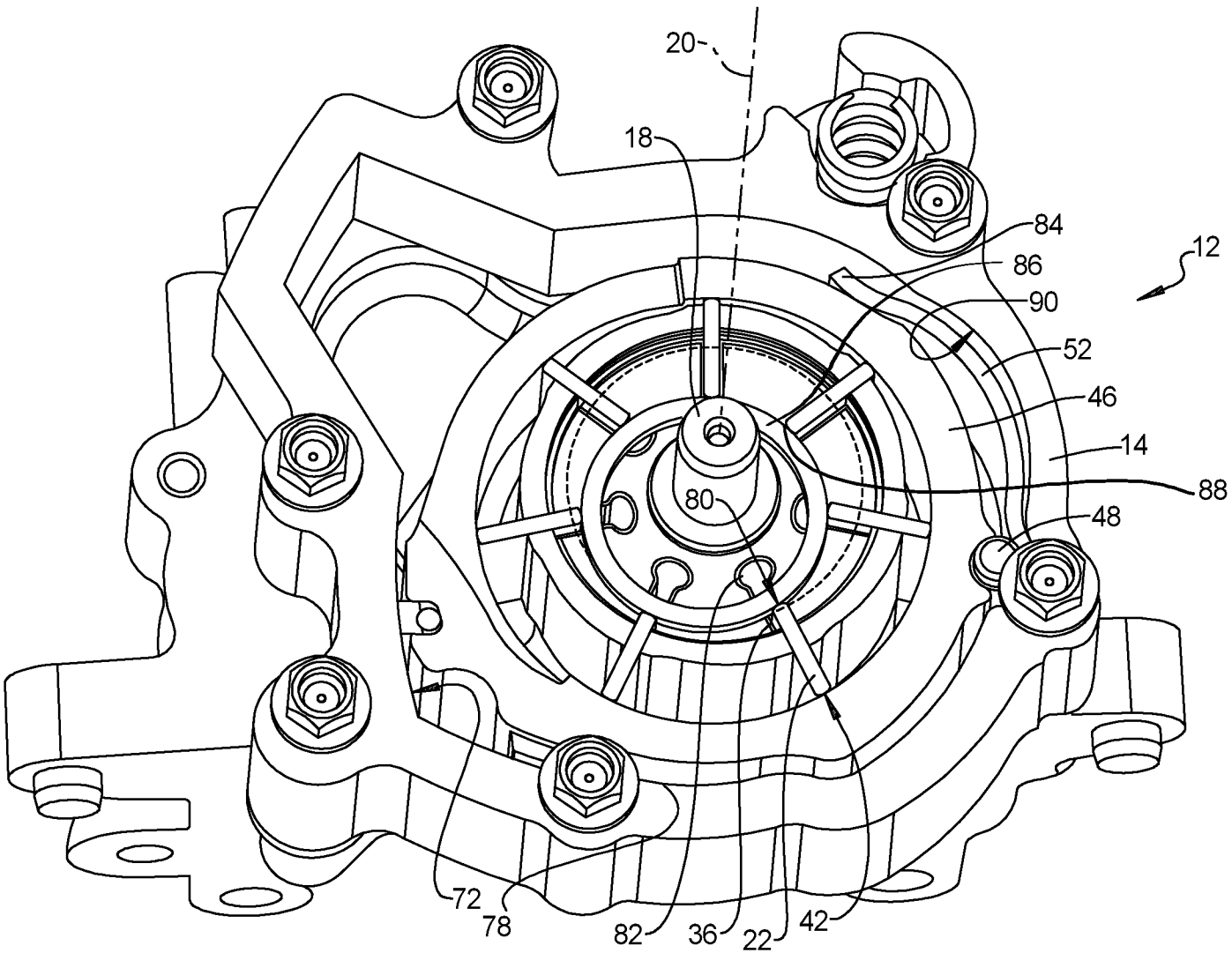
FIG. 2 is a top perspective view of the variable displacement pump of FIG. 1.

To initiate pumping flow, the axis of both vane support rings 86 is displaced to an off-axis position with respect to the longitudinal axis 20 of the pump shaft 18 by rotating the slide 46 using the biasing force of the bow spring plate 52. As previously noted, the vanes have their outward ends 42 in direct sliding contact with or spaced at a minimum clearance dimension with respect to the circular-shaped inner wall 44 of the slide 46. The vanes also have an inward end 88 directly contacting the vane support rings 86 (only one of which is shown in this view), therefore because the vanes have an equal length, as the vane support rings 86 are displaced to the off-axis position with respect to the longitudinal axis 20 the vane support rings 86 traverse an obround path of motion 90 as the pump shaft 18 rotates about the longitudinal axis 20. The vanes radially inwardly or radially outwardly displace within the vane slot that the individual vanes are disposed within as the vane support rings 86 rotate. For example, the first vane 22 is shown in FIGS. 1 and 2 in a substantially maximum radially outward displaced position within the first vane slot 36, while the fifth vane 30 is shown in a substantially fully radially inward displaced position within its vane slot. This exposes a greater surface area of the first vane 22 at the mid-point 66 within the flow passage 62. The vane slots such as the first vane slot 36 also include a fluid ingress and egress through passage 92 to allow oil flow into or out of the slots to provide free sliding motion of the vane within the respective vane slot.

To minimize frictional contact between the bow spring plate 52 and the slide 46, a free first end 94 of the bow spring plate 52 defines a curve having a convex shaped portion in direct contact with a curved outer wall portion 96 of the slide 46. A formed second end 98 of the bow spring plate 52 directly contacts the dowel pin 48 and is frictionally captured between the dowel pin 48 and the inner wall portion 78 of the pump body 14 in the installed position of the bow spring plate 52.

Referring to FIG. 3 and again to FIGS. 1 and 2, the convex shaped portion of the free first end 94 of the bow spring plate 52 provides a convex surface 102. The formed second end 98 of the bow spring plate 52 provides a concave surface 104 to receive the dowel pin 48. A curving wall 106 extends between the free first end 94 and the formed second end 98 of the bow spring plate 52.

Figure 3:
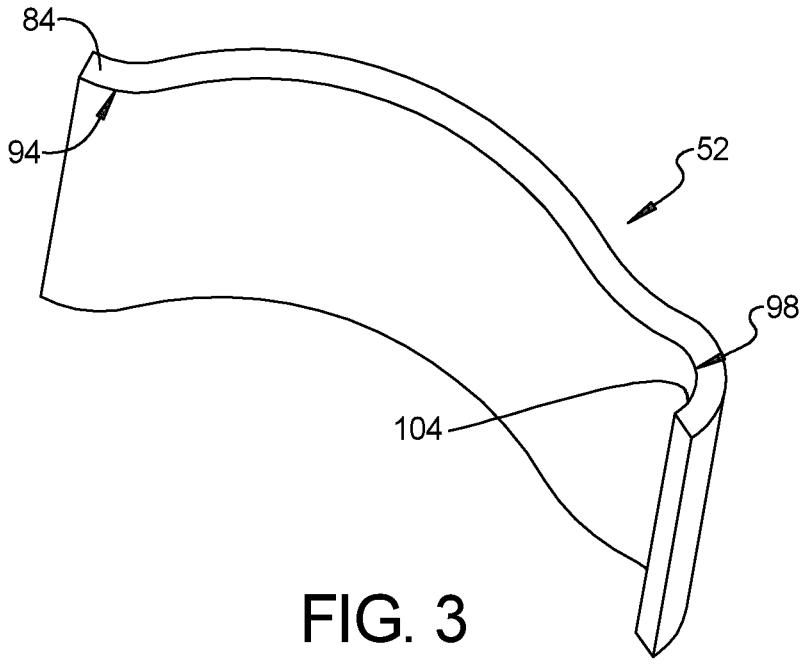
FIG. 3 is a top perspective view of a bow spring for the variable displacement pump of FIG. 1.
Figure 4:
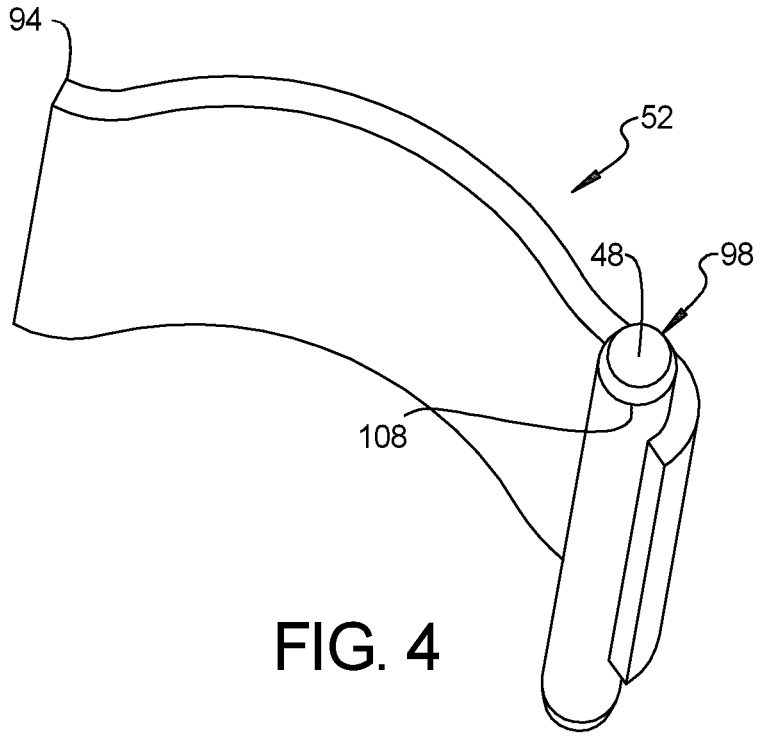
FIG. 4 is a top perspective view of the bow spring of FIG. 3 further showing a dowel pin providing a pivot point for the bow spring.

Referring to FIG. 4 and again to FIGS. 1 through 3, a radius of curvature of the concave surface 104 of the formed second end 98 of the bow spring plate 52 mimics a radius of curvature 108 of the dowel pin 48. This ensures contact is maintained between the concave surface 104 and an outer surface of the dowel pin 48.

Referring to FIG. 5 and again to FIGS. 1 through 4, a biasing force 110 generated by the bow spring plate 52 acting toward the pump shaft 18 is less than, equal to or greater than an overall pressure force 112 of the fluid within the outer chamber 74 acting equally and oppositely to the biasing force of the bow spring plate 52 to move the slide 46 against the biasing force of the bow spring plate 52. The overall pressure force 112 represented for example as multiple pressure force arrows is created by oil feedback pressure present at the gallery port 72 from the engine main gallery (not shown) which pressurizes the outer chamber 74 independently of oil pressure directed into the low-pressure intake cavity 60. According to several aspects a bump or stop 114 extends outwardly from the outer wall portion 96 of the slide 46. The stop 114 directly contacts the inner wall portion 78 of the pump body 14 defining a maximum position of rotation of the slide 46.

According to several aspects the second end 98 of the bow spring plate 52 directly contacts the dowel pin 48 and is frictionally captured between the dowel pin 48 and an inner wall portion 78 of the pump body 14 in the installed position of the bow spring plate 52. According to further aspects the second end 98 of the bow spring plate 52 is modified to be frictionally captured in a slot 120 created in the wall of the pump body 14. In any of its configurations the bow spring plate 52 is positioned in a second outer chamber 122 located between the slide 46 and the pump body 14 which is exposed to pressurized fluid such as the low-pressure oil entering the low-pressure intake cavity 60.

Referring to FIG. 6 and again to FIGS. 1 through 5, a loading length, a thickness and a width of the bow spring plate 52 are determined using known equations 1, 2 and 3 below for a cantilever beam loaded in bending given a modulus of elasticity of the material selected. The loading length is determined based on a distance 124 between a first point-of-contact 126 of the first end 94 of the bow spring plate 52 with the outer wall portion 96 of the slide 46 (as shown in FIGS. 2 and 6) and a second point-of-contact 128 of the concave surface 104 of the second end 98 of the bow spring plate 52 with the dowel pin 48 for the installed configuration of the bow spring plate 52 shown in FIG. 5. A spring thickness 116 and a spring width 118 are also incorporated into the determination of the load capability of the bow spring plate 52.

Moment of bending $M=FL$ Equation 1:

where: (F) is applied force and (L) is the length of beam at application of force (distance 124)

Deflection $(\delta)=FL^3/3EI$ Equation 2:

where: E=modulus of elasticity, and
I=moment of inertia

Figure 5:
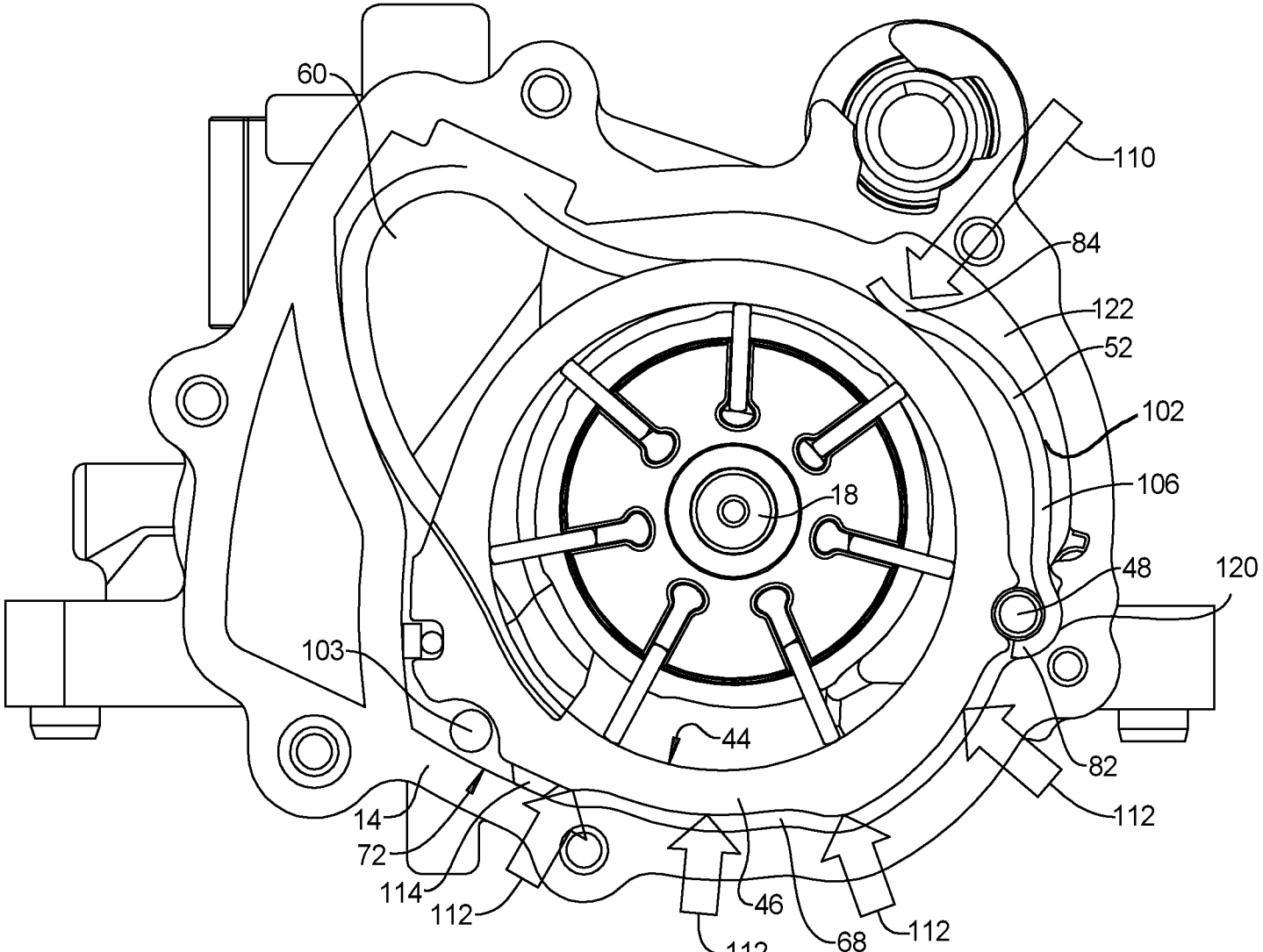
FIG. 5 is a top plan view of the variable displacement pump of FIG. 1 shown in a fully biased and rotated position of a slide.
Figure 6:
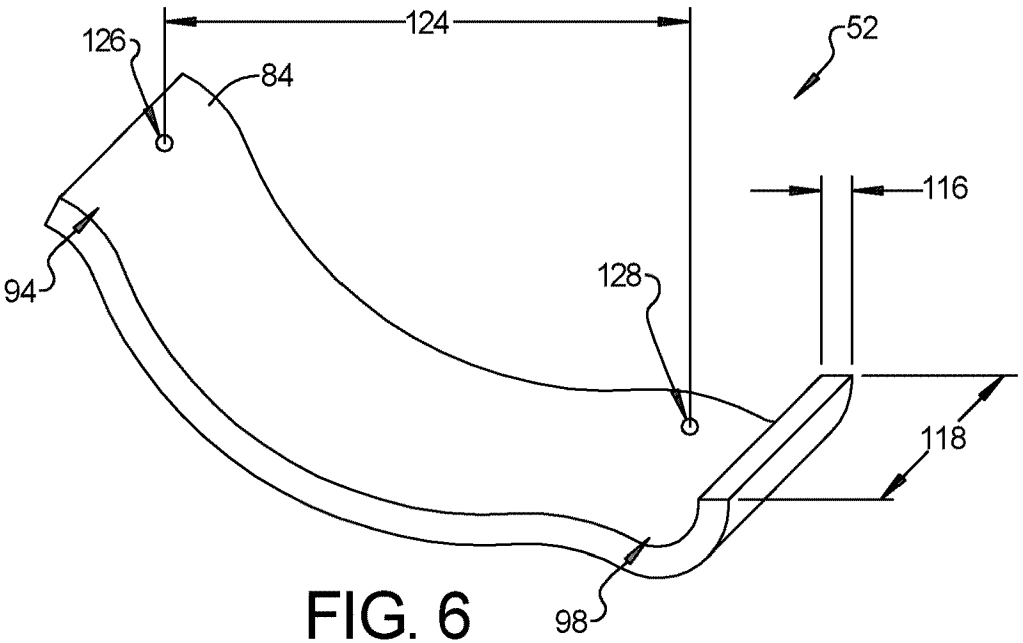
FIG. 6 is a front side perspective view of the bow spring of FIG. 3.
Figure 7:
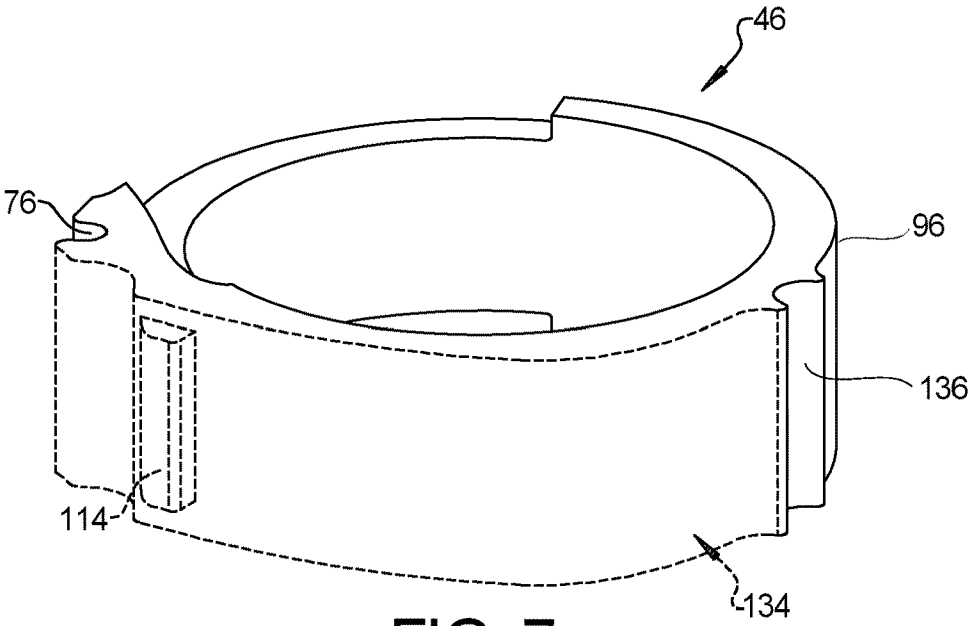
FIG. 7 is a front perspective view of a slide of the variable displacement pump of FIG. 1.

Slope $(\theta)=FL^2/2EI$ Equation 3:

Referring to FIG. 7 and again to FIGS. 5 and 6, the applied force F (biasing force 110) of the bow spring plate 52 is at least equal to the overall pressure force 112 acting to move the slide 46 against the biasing force 110 of the bow spring plate 52. As noted above the overall pressure force 112 defined below as Fp is generated as feedback pressure from the engine main gallery. The overall pressure force 112 can be calculated from Equation 4 as follows:

Pressure Force $Fp=P\times A$ Equation 4:

where P=feedback pressure; and
A=area over which the pressure acts, defined as a surface area 134 of the slide 46 over which the feedback pressure acts, between the outer chamber 74 and a dowel pin cavity 136 where the dowel pin 48 is seated.

While the present disclosure is directed to variable displacement hydraulic pumps used in automobile vehicle engine oil systems, the variable displacement pump of the present disclosure can also be used in other systems including supercharging, power-steering, air conditioning and automatic-transmission pumps.

A variable displacement pump of the present disclosure offers several advantages. These include provision of a bow spring plate biasing member that is smaller than common coiled springs, thereby reducing a space envelope of the variable displacement pump. The bow spring plate provides a more predictable linear spring force than a coiled spring. The deflection of the bow spring plate is more linear than a coiled spring, particularly within a 30% to 70% deflection of the coiled spring, thereby providing a more linear pump output. Weight and cost are also reduced for the variable displacement pump of the present disclosure as a coil spring retainer is not required.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An automobile vehicle variable displacement pump, comprising:

a pump body having a pump shaft extending through the pump body, the pump shaft rotating with respect to a longitudinal axis of the pump shaft;

a slide rotatably connected to the pump body;

a bow spring plate defining a biasing member directly contacting the slide to bias the slide to rotate in an arc of curvature within the pump body; and a dowel pin positioned within a dowel pin cavity of the slide, the dowel pin rotatably connecting the slide to an inner wall of the pump body, the dowel pin defining an axis of rotation for rotational movement of the slide with respect to an arc of rotation of the slide, wherein the bow spring plate is anchored at an end of the bow spring plate to the dowel pin between the dowel pin and the pump body such that the biasing member rotates with the slide as the slide rotates with respect to the axis of rotation defined by the dowel pin.

2. The automobile vehicle variable displacement pump of claim 1, further including a dowel pin positioned within a dowel pin cavity of the slide, the dowel pin rotatably connecting the slide to an inner wall of the pump body.

3. The automobile vehicle variable displacement pump of claim 2, wherein the bow spring plate is anchored at an end of the bow spring plate between the dowel pin and the pump body.

4. The automobile vehicle variable displacement pump of claim 2, wherein the slide includes a seal positioned within a seal cavity and wherein a load force generated by the bow spring plate is equal to an oppositely directed pressure force acting against a surface of the slide between the seal cavity and the dowel pin cavity.

5. The automobile vehicle variable displacement pump of claim 1, further including a rotor connected to the pump shaft and co-rotating with the pump shaft, the rotor having multiple radially outwardly directed slots.

6. The automobile vehicle variable displacement pump of claim 5, further including a vane support ring supporting multiple vanes, the vanes individually slidably received in one of the slots of the rotor, the vanes rotating with the vane support ring by rotation of the rotor.

7. The automobile vehicle variable displacement pump of claim 6, wherein the slide includes a circular-shaped inner wall, the rotor and the vane support ring being positioned within the inner wall of the slide.

8. The automobile vehicle variable displacement pump of claim 7, wherein the vanes have an outward end maintained in direct contact with the inner wall of the slide as the vane support ring co-rotates with the rotor.

9. The automobile vehicle variable displacement pump of claim 1, wherein the bow spring plate directly contacts the slide at an end of the bow spring plate defining a convex surface.

10. An automobile vehicle variable displacement pump, comprising:

a pump body having a pump shaft extending through the pump body;

a rotor connected to the pump shaft and co-rotating with the pump shaft, the rotor having multiple radially outwardly directed slots;

a vane support ring supporting multiple vanes, one vane individually slidably received in one of the slots of the rotor;

a slide rotatably connected to the pump body having the rotor and the vane support ring positioned within an inner wall of the slide;

a bow spring plate defining a biasing member directly contacting the slide to bias the slide to rotate in an arc of curvature and;

a dowel pin positioned within a dowel pin cavity of the slide, the dowel pin rotatably connecting the slide to an inner wall of the pump body, the dowel pin defining an axis of rotation for rotational movement of the slide with respect to an arc of rotation of the slide, wherein the bow spring plate is anchored at an end of the bow spring plate to the dowel pin between the dowel pin and the pump body such that the biasing member rotates with the slide as the slide rotates with respect to the axis of rotation defined by the dowel pin.

11. The automobile vehicle variable displacement pump of claim 10, wherein the slide includes a seal cavity having a seal positioned within the seal cavity contacting a pump body inner wall, the seal acting to limit fluid from entering an outer chamber positioned between the slide and the pump body.

12. The automobile vehicle variable displacement pump of claim 11, wherein a load force generated by the bow spring plate is equal to an oppositely directed pressure force acting against a surface of the slide within the outer chamber.

13. The automobile vehicle variable displacement pump of claim 10, further including a first end of the bow spring plate having a convex shaped portion in direct sliding contact with a curved outer wall portion of the slide acting to minimize frictional contact between the bow spring plate and the slide.

14. The automobile vehicle variable displacement pump of claim 10, wherein the bow spring plate includes an end seated in a slot created in a wall of the pump body.

15. An automobile vehicle variable displacement pump, comprising:

a pump body having a pump shaft extending through the pump body, the pump shaft rotating with respect to a longitudinal axis of the pump shaft;

a rotor connected to the pump shaft and co-rotating with the pump shaft with respect to the longitudinal axis of the pump shaft, the rotor having multiple radially outwardly directed slots;

a vane support ring supporting multiple vanes, one vane individually slidably received in one of the slots of the rotor, and rotated by contact between the vanes and the rotor during rotation of the rotor, the vane support ring traveling in motion as the pump shaft rotates about the longitudinal axis;

a slide rotatably connected to the pump body having the rotor and the vane support ring positioned within an inner wall of the slide;

a bow spring plate defining a biasing member directly contacting the slide to bias the slide to rotate in an arc of curvature, a biasing force generated by the bow spring plate acting toward the pump shaft and opposing an overall pressure force of a fluid within an outer chamber between the slide and the pump body;

a dowel pin positioned within a dowel pin cavity of the slide, the dowel pin rotatably connecting the slide to a pump body inner wall, the dowel pin defining an axis of rotation for rotational movement of the slide with respect to an arc of rotation of the slide; and the bow spring plate including a first end defining a convex surface directly contacting the slide and a second end anchored to the dowel pin between the dowel pin and the pump body such that the biasing member rotates with the slide as the slide rotates with respect to the axis of rotation defined by the dowel pin.

16. The automobile vehicle variable displacement pump of claim 15, wherein the bow spring plate includes a first end defining a convex surface directly contacting the slide and a second end seated in a slot created in a wall of the pump body.

* * * * *